US009755340B2

(12) United States Patent
Nakamura

(10) Patent No.: US 9,755,340 B2
(45) Date of Patent: Sep. 5, 2017

(54) CONNECTOR

(71) Applicant: Japan Aviation Electronics Industry, Limited, Tokyo (JP)

(72) Inventor: Keisuke Nakamura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 15/177,786

(22) Filed: Jun. 9, 2016

(65) Prior Publication Data

US 2017/0085019 A1 Mar. 23, 2017

(30) Foreign Application Priority Data

Sep. 18, 2015 (JP) ..... 2015-185405

(51) Int. Cl.
*H01R 12/77* (2011.01)
*H01R 12/88* (2011.01)

(52) U.S. Cl.
CPC ..... *H01R 12/772* (2013.01); *H01R 12/88* (2013.01)

(58) Field of Classification Search
CPC ..... H01R 12/61; H01R 12/77; H01R 12/771; H01R 12/721; H01R 12/79; H01R 12/88; H01R 12/82; H01R 13/639
See application file for complete search history.

(56) References Cited

U.S. PATENT DOCUMENTS 6,726,497 B2 * 4/2004 Nogawa ..... H01R 12/88 439/260
7,448,893 B2 * 11/2008 Suzuki ..... H01R 12/79 439/260
8,579,654 B2 * 11/2013 Chen ..... H01R 12/61 439/267
8,613,631 B2 * 12/2013 Hemmi ..... H01R 12/88 439/260
2009/0017645 A1 * 1/2009 Suzuki ..... H01R 12/88 439/62
2009/0068860 A1 * 3/2009 Suzuki ..... H01R 12/88 439/67
2010/0087078 A1 * 4/2010 Hemmi ..... H01R 12/774 439/260
2013/0137284 A1 * 5/2013 Shindo ..... H01R 12/774 439/153
2014/0242846 A1 * 8/2014 Miki ..... H01R 12/79 439/630

FOREIGN PATENT DOCUMENTS

JP 2004-206987 A 7/2004

* cited by examiner

*Primary Examiner* — Amy Cohen Johnson
*Assistant Examiner* — Oscar C Jimenez
(74) *Attorney, Agent, or Firm* — Collard & Roe, P.C.

(57) ABSTRACT

When a connection object is connected to a connector, an upper jaw portion of a first terminal presses an upper contact point against an upper signal line. Hence a lower signal line is pressed against a lower contact point so that a contact point support portion is pressed against a stop portion of a housing. At least a part of force applied to the stop portion acts as force to deform downward an upper wall of a receiving portion for receiving a lower jaw portion of the first terminal. A reinforcing portion of the lower jaw portion of the first terminal reinforces the upper wall from beneath. Since strength necessary for the upper wall can be reduced, the housing can be downsized and thus the connector can be downsized.

8 Claims, 8 Drawing Sheets

CONNECTOR

CROSS REFERENCE TO RELATED APPLICATIONS

This application is based on and claims priority under 35 U.S.C. §119 to Japanese Patent Application No JP2015-185405 filed Sep. 18, 2015, the contents of which are incorporated herein in their entirely by reference.

BACKGROUND OF THE INVENTION

This invention relates to a connector connectable with a plate-like or sheet-like connection object, such as a flexible printed circuit (FPC) or a flexible flat cable (FFC), and particularly to a connector connectable with a connection object having signal lines provided on both sides thereof.

JP 2004-206987A (Patent Document 1) discloses a type of a connector. Referring to FIG. 16, a connector 900 of Patent Document 1 is provided with first terminals 910 made of conductor, second terminals 920 made of conductor, a housing 930 made of insulator and an actuator 940 made of insulator. In a state where the actuator 940 is opened, a connection object 950 is inserted into the connector 900. After that, closing the actuator 940 as illustrated in FIG. 16, the first terminals 910 are deformed so that the first terminals 910 and the second terminals 920 interpose the connection object 950 between them. Thus, signal lines formed on both sides of the connection object 950 are connected to the first terminals 910 and the second terminals 920.

SUMMARY OF THE INVENTION

It is an object of the present invention to provide a connector which is connectable with a connection object having signal lines on its both sides and which is downsized.

One aspect of the present invention provides a connector which is connectable with a connection object having a plate-like or sheet-like shape and mountable on a mounting object. The connection object has an upper surface and a lower surface in an up-down direction. The upper surface and the lower surface are formed with an upper signal line and a lower signal line, respectively. The connector comprises at least one first terminal, at least one second terminal and a housing. The housing is formed with a stop portion and a receiving portion extending in a front-rear direction perpendicular to the up-down direction. The housing has an upper wall defining an upper surface of the receiving portion. The stop portion continues to the upper wall or is formed of a part of the upper wall. The at least one first terminal is held by the housing. Each of the at least one first terminal has an upper jaw portion, a lower jaw portion and a first fixed portion. The upper jaw portion is provided with an upper contact point which is movable at least in the up-down direction. The lower jaw portion is situated at a position lower than the upper jaw portion in the up-down direction. The lower jaw portion is received by the receiving portion. The lower jaw portion is provided with a reinforcing portion. The first fixed portion is fixed to the mounting object when the connector is mounted on the mounting object. The at least one second terminal is distinct and separated from the at least one first terminal and held by the housing. Each of the at least one second, terminal has two end portions. One of the end portions is formed with a second fixed portion which is fixed to the mounting object when the connector is mounted on the mounting object. A remaining one of the end portions is provided with a contact point support portion. The contact point support portion is formed with a lower contact point thereon. When the connection object is connected to the connector, the upper jaw portion presses the upper contact point against the upper signal line. Hence the lower signal line presses the contact point support portion against the stop portion via the lower contact point, and the upper wall receives force for deforming the upper wall downward. The reinforcing portion reinforces the upper wall from beneath.

The upper jaw portion of the firs terminal presses tale upper contact point against the connection object. The connection object, which is pressed, presses the contact point support portion against the stop portion of the housing via the lower contact point of the second terminal. At least a part of the force received by the stop portion acts as force for deforming downward the upper wall of the receiving portion for receiving the lower jaw portion of the first terminal. The reinforcing portion of the lower jaw portion reinforces the upper wall to reduce the strength necessary for the upper wall. Accordingly, the housing can be downsized, and thus the whole of the connector can be downsized as well.

An appreciation of the objectives of the present invention and a more complete understanding of its structure may be had by studying the following description of the preferred embodiment and by referring to the accompanying drawings.

Figure 1:
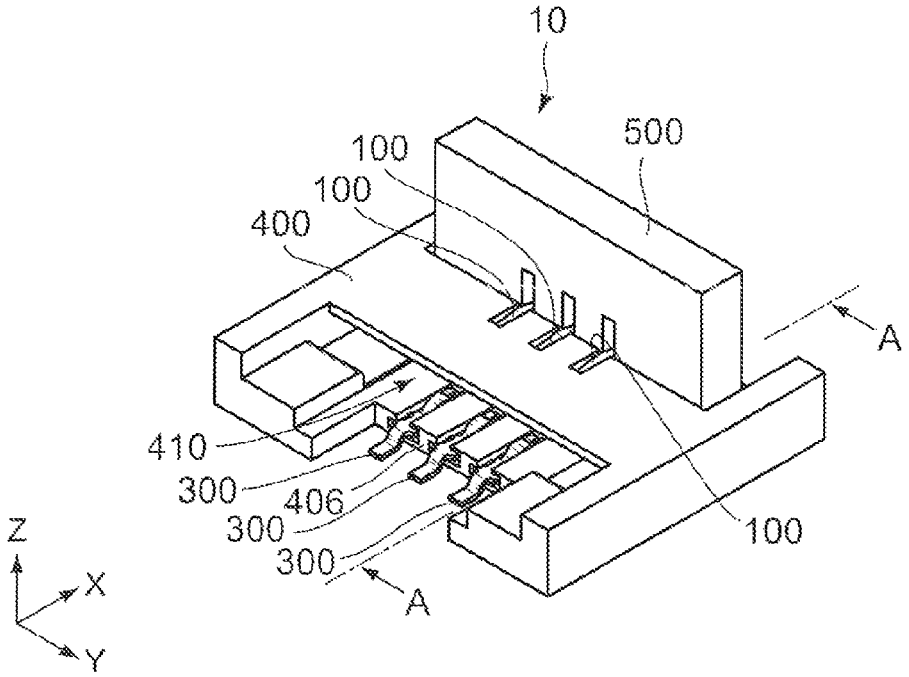
FIG. 1 is a perspective view illustrating a connector according to a first embodiment of the present invention. An actuator included in the connector illustrated is in an open state.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 10:
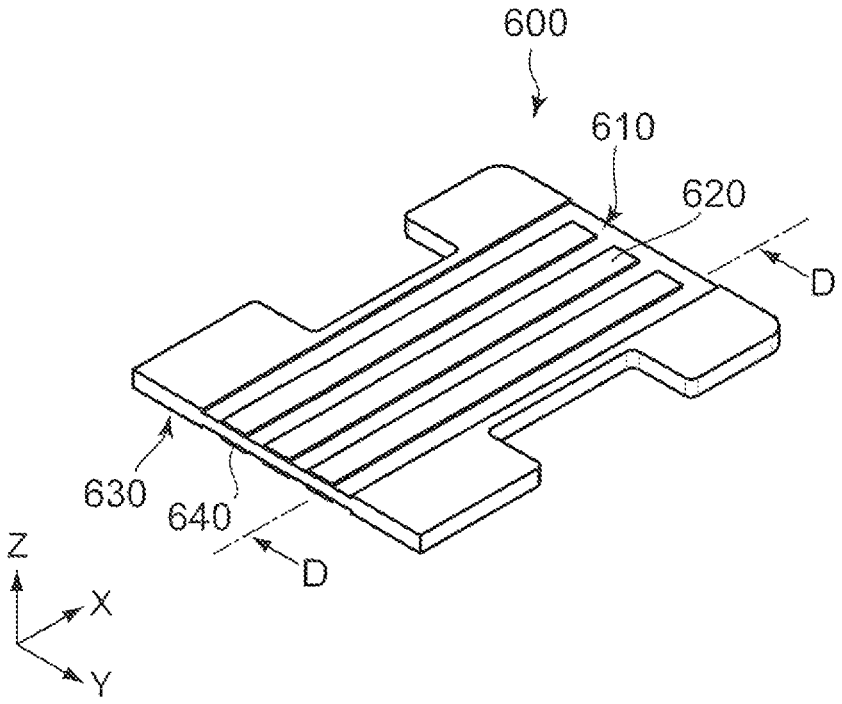
FIG. 10 is a perspective view illustrating the connection object connected to the connector of FIG. 3.
Figure 11:
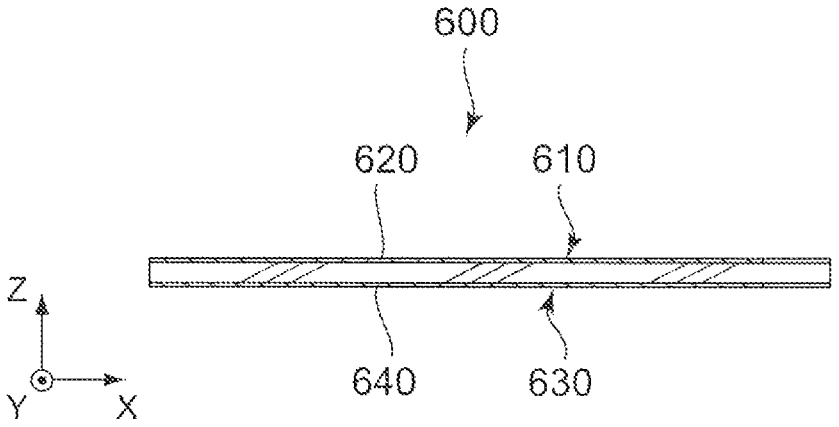
FIG. 11 is a crass-sectional view illustrating the connection object of FIG. 10, taken along line D-D.

Referring to FIGS. 1 to 4, a connector 10 according to a first embodiment of the present invention is mounted on and fixed to a circuit board (a mounting object, not shown) when used. The connector 10 is connectable to a connection object 600 having a plate-like or sheet-like shape. As illustrated in FIGS. 10 and 11, the connection object 600 has an upper surface 610 and a lower surface 630 in an up-down direction (a Z-direction). In the present embodiment, the upper surface 610 is formed with three upper signal lines 620 while the lower surface 630 is formed with three lower signal lines 640. The upper signal lines 620 are arranged in a pitch direction (a Y-direction) perpendicular to the up-down direction on the upper surface 610. Similarly, the lower signal lines 640 are arranged in the pitch direction on the lower surface 630. The structure of the connection object 600 however, is not limited thereto in the present invention. The number of the upper signal lines 620 may be smaller or larger than three. Similarly, the number of the lower signal lines 640 may be smaller or larger than three. Furthermore, the number of the upper signal lines 620 and the number of the lower signal lines 640 may be different from each other. For example, a single common electrode may be used as a substitute of the upper signal lines 620 or the lower signal lines 640.

As understood from FIGS. 1 to 4, the connector 10 is provided with three first terminals 100 made of conductor, three second terminals 300 made of conductor, a housing 400 made of insulator and an actuator 500 made of insulator. The first terminals 100 are distinct and separated from one another. Similarly, the second terminals 300 are distinct and separated from one another. The number of the first terminals 100 and that of the second terminals 300 are equal to each other in the present embodiment. The first terminals 100 correspond to the second terminals 300, respectively. Although the number of the first terminals 100 and the number of the second terminals 300 are decided according to the structure of the connection object 600, they may be one or more each.

Figure 2:
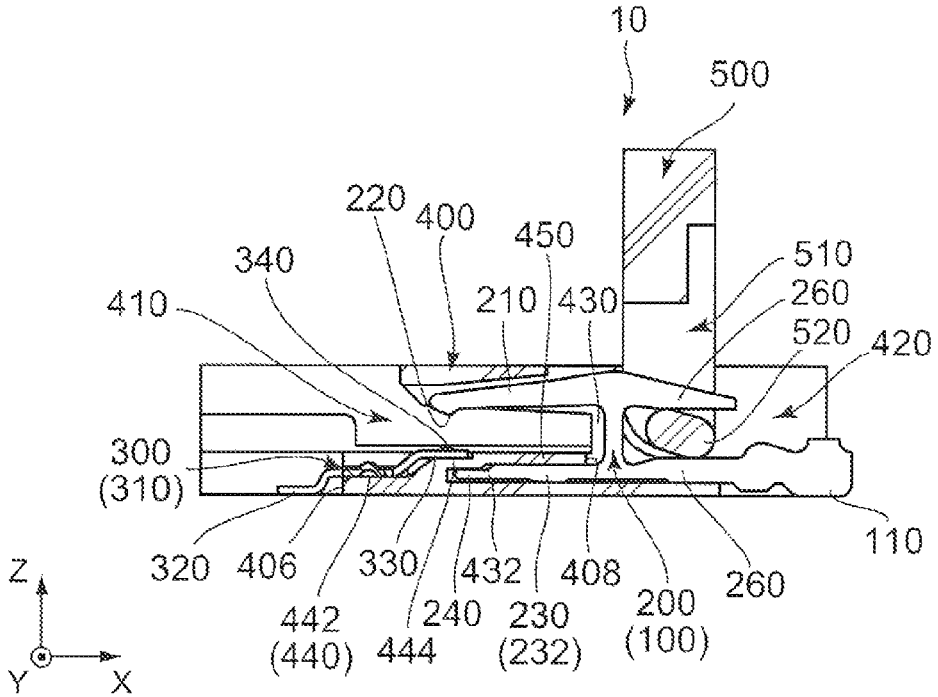
FIG. 2 is a cross-sectional view illustrating the connector of FIG. 1, taken along line A-A.
Figure 3:
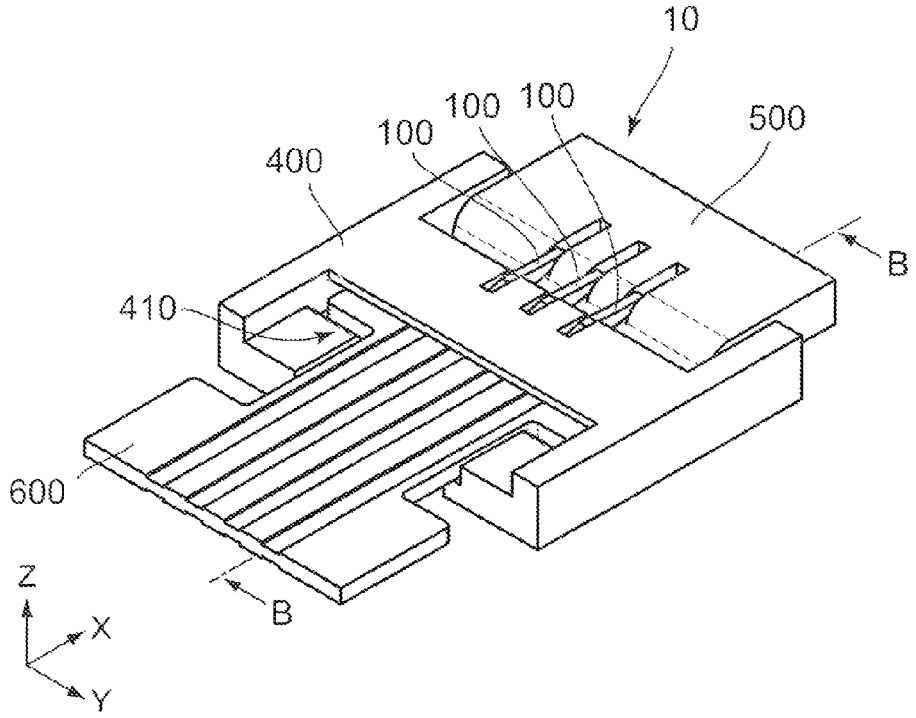
FIG. 3 is a perspective view illustrating the connector of FIG. 1 with a connection object. The connection object is connected to the connector, and the actuator is in a close state.
Figure 7:
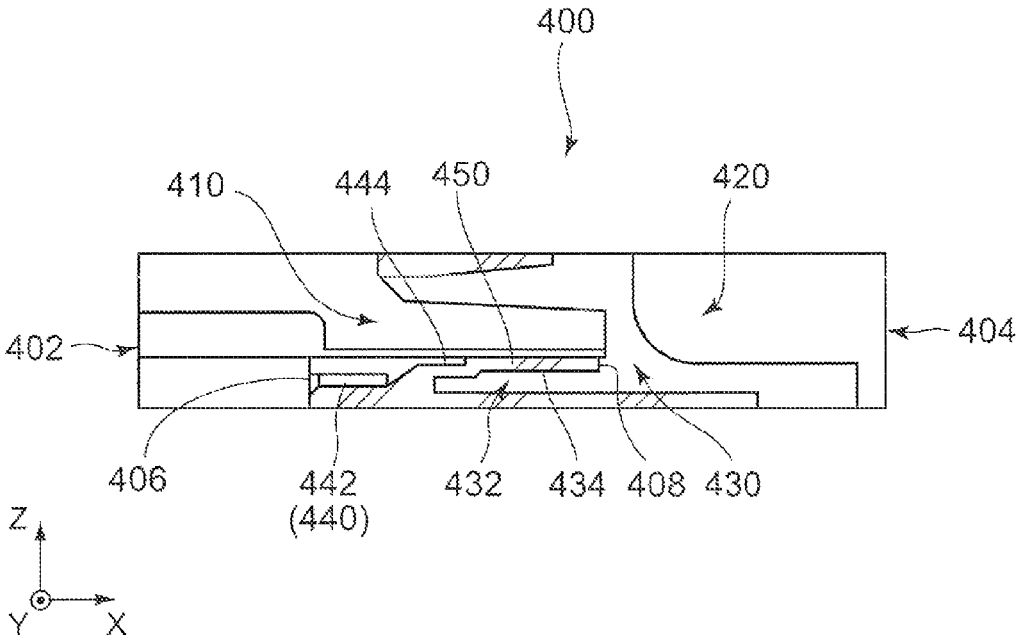
FIG. 7 is a cross-sectional view illustrating a housing included in the connector of FIG. 2.

As understood from FIGS. 1, 2 and 7, the housing 400 is formed with an object receiving portion 410 which receives the connection object 600 (see FIG. 4), an actuator accommodation portion 420 which accommodates the actuator 500 in part, first terminal accommodation portions 430 and second terminal accommodation portions 440. The housing 400 has a front end 402 and a rear end 404 in a front-rear direction (an X-direction) perpendicular to both of the up-down direction and the pitch direction. The object receiving portion 410 is opened in the front end 402. The actuator accommodation portion 420 is situated toward the rear end 404 and opened backward (toward a positive-X direction) and upward (toward a positive-Z direction). The first terminal accommodation portions 430 correspond to the first terminals 100, respectively, and connect between the object receiving portion 410 and the actuator accommodation portion 420. Each of the first terminal accommodation portions 430 has a lower jaw receiving portion (receiving portion) 432 for receiving a lower jaw portion 230 (see FIG. 5) of the first terminal 100. The lower jaw receiving portion 432 extends forward (toward a negative-X direction) in the front-rear direction (the X-direction) and reaches a place below a stop portion 444. An upper surface 434 of the lower jaw receiving portion 432 is a lower surface of an upper wall 450 of the housing 400. In other words, the housing 400 has the upper wall 450 defining the upper surface 434 of the lower jaw receiving portion 432. The upper wall 450 has an upper wall rear end 408. The second terminal accommodation portions 440 correspond to the second terminals 300, respectively, and are opened forward and upward. Each of the second terminal accommodation portions 440 has a holding portion 442 and the stop portion 444. The stop portion 444 is a rearward (positive-X side) area of a bottom surface of the second terminal accommodation portion 440. In the present embodiment, the stop portion 444 is situated above the lower jaw receiving portion 432 at least in part. That is, at least a part of the stop portion 444 is formed of a part of the upper wall 450. However, the present invention is not limited thereto. Provided that the stop portion 444 and the upper wall 450 continue to each other, the stop portion 444 and the upper wall 450 (or the lower jaw receiving portion 432) may be distant from each other in the front-rear direction (the X-direction).

Figure 5:
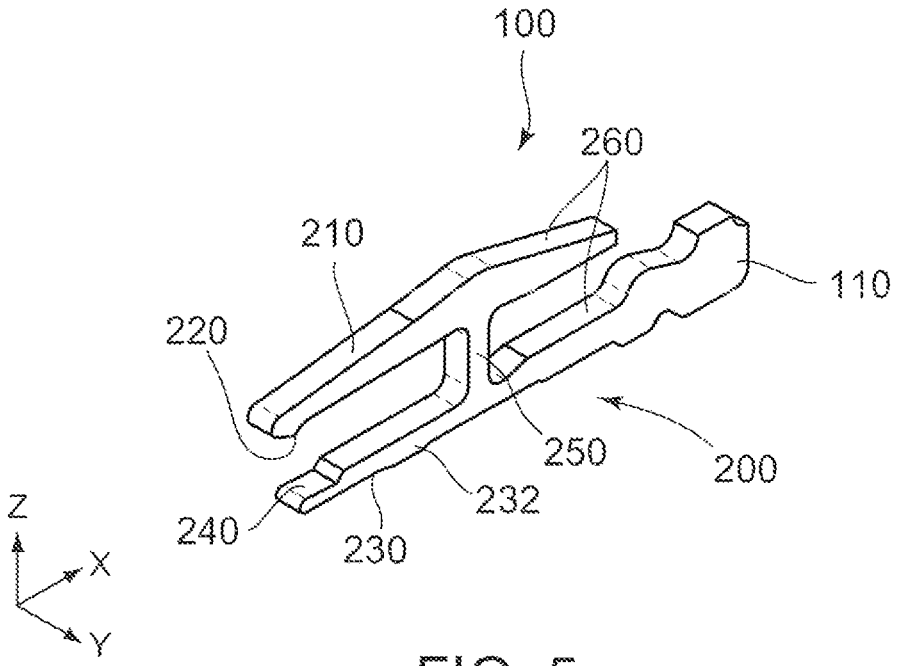
FIG. 5 is a perspective view illustrating a first terminal included in the connector of FIG. 1.

As illustrated in FIG. 5, each of the first terminals 100 has a first fixed portion 110 and a first terminal main portion 200. The first fixed portion 110 is a part that is fixed to the circuit board (the mounting object, not shown) when the connector 10 is mounted on and fixed to the circuit board. The first fixed portion 110 of the present embodiment is situated in the vicinity of the rear end 404 of the connector 10.

As illustrated in FIG. 5, the first terminal main portion 200 of the first terminal 100 has an upper jaw portion 210, the lower jaw portion 230, a coupling portion 250 coupling the upper jaw portion 210 with the lower jaw portion 230 and actuated portions 260. The upper jaw portion 210 extends forward (toward the negative-X direction) from the coupling portion 250. The upper jaw portion 210 is provided with an upper contact point 220. The upper contact point 220 protrudes downward (toward a negative-Z direction). The upper contact point 220 can move at least in the up-down direction due to elastic deformation of at least one of the upper jaw portion 210 and the coupling portion 250. The lower jaw portion 230 extends forward from the coupling portion 250 and is situated at a position lower than the upper jaw portion 210 in the up-down direction. The lower jaw portion 230 has a press-fit portion 232. The press-fit portion 232 is press-fit into and fixed to the lower jaw receiving portion 432. Thus, the first terminal 100 is held by the housing 400. The lower jaw portion 230 is also provided with a reinforcing portion 240. The reinforcing portion 240 is situated in front (at a negative-X side) of the press-fit portion 232. The reinforcing portion 240 of the present embodiment has a plane surface of a rectangular shape (specifically, a plane surface perpendicular to the up-down direction). In the present embodiment, the reinforcing portion 240 is situated in the rear of the upper contact point 220 in the front-rear direction. The actuated portions 260 form a C-shape together with the coupling portion 250. The actuated portions 260 are parts actuated by the actuator 500 as mentioned later.

Figure 4:
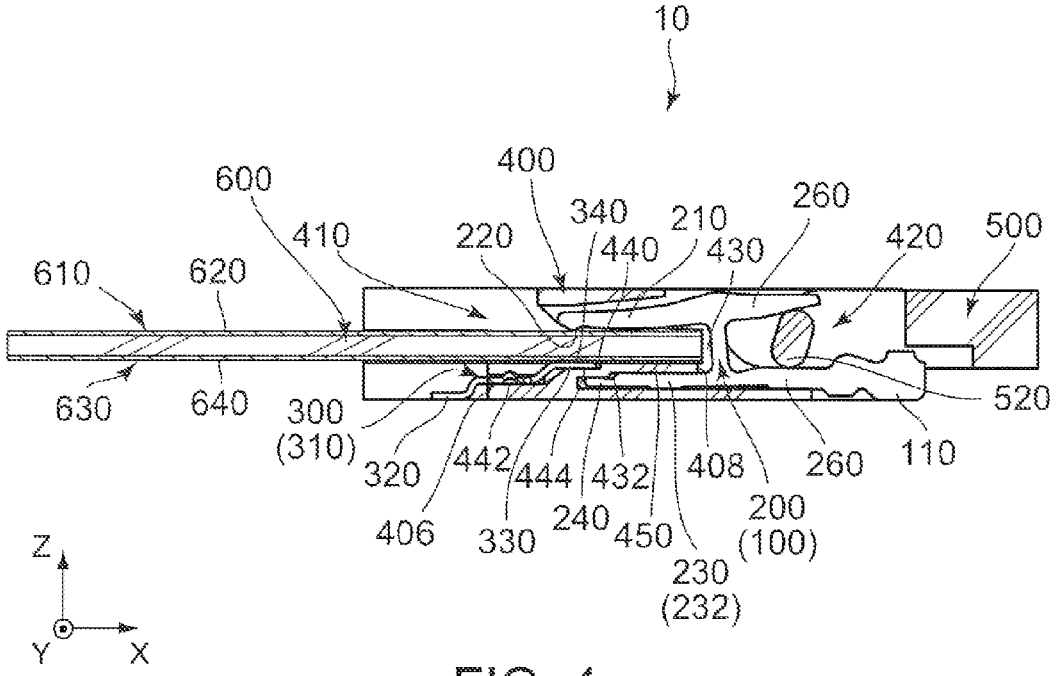
FIG. 4 is a cross-sectional view illustrating the connector and the connection object of FIG. 3, taken along line B-B.

As illustrated in FIGS. 2 and 4, the lower jaw portion 230 is received by the lower jaw receiving portion 432 to be directed forward so that the press-fit portion 232 is press-fit into the lower jaw receiving portion 432. As a result, the first terminal 100 is held by the housing 400. Particularly, as understood from FIGS. 1 and 3, the first terminals 100 are arranged in the pitch direction (the Y-direction). As illustrated in FIG. 2, in a state here the upper contact point 220 protrudes into the object receiving portion 410, the first terminal 100 is received by the first terminal accommodation portion 430 in part. At this time, the reinforcing portion 240 abuts on the upper surface 434 (see FIG. 7) of the lower jaw receiving portion 432 or the lower surface of the upper wall 450. In the present embodiment, as illustrated in FIGS. 2 and 4, the actuated portions 260 are accommodated in part in the actuator accommodation portion 420.

Figure 6:
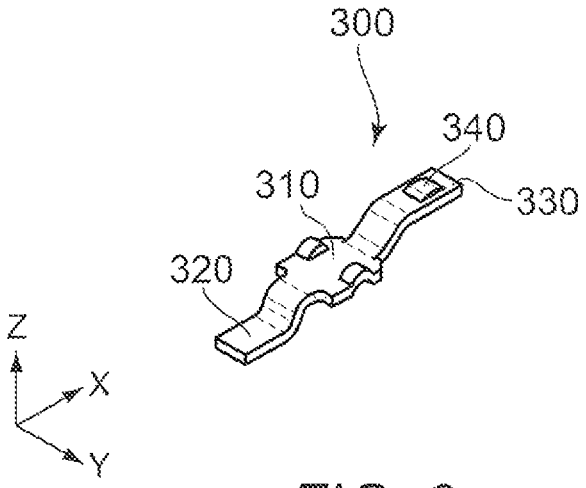
FIG. 6 is a perspective view illustrating a second terminal included in the connector of FIG. 1.

As apparent from FIGS. 2, 5 and 6, the second terminal 300 is distinct and separated from the first terminal 100. As illustrated in FIG. 6, each of the second terminals 300 has two end portions and a stepped shape. Specifically, the second terminal 300 has a second held portion 310, a second fixed portion 320, a contact point support portion 330 and a lower contact point 340. The second held portion 310, the second fixed portion 320 and the contact point support portion 330 have a plate-like shape intersecting with the up-down direction each. The second fixed portion 320 is formed on one of the end portions of the second terminal 300 while the contact point support portion 330 is formed on the other of the end portions of the second terminal 300. The second held portion 310 is situated between the second fixed portion 320 and the contact point support portion 330. The second held portion 310 is provided with a pair of protruding portions (or press-fit portions).

As understood from FIGS. 1, 2, 6 and 7, the second held portion 310 is a part held by the holding portion 442 of the housing 400. In the present embodiment, the second held portion 310 is situated in the vicinity of a middle portion front end 406 of the housing 400. The second fixed portion 320 is a part fixed to the circuit board (the mounting object, not shown) when the connector 10 is mounted on and fixed to the circuit board. The second fixed portion 320 of the present embodiment is situated in front of the middle portion front end 406 of the housing 400 and extends forward (toward the negative-X direction) in a place lower than (at a negative-Z side of) the second held portion 310.

As illustrated in FIG. 6, the contact point support portion 330 is situated at a position upper than (at a positive-Z side of) the second held portion 310 and extends backward (toward the positive-X direction). The contact point support portion 330 supports the lower contact point 340 from beneath (the negative-Z side). In other words, the lower contact point 340 is formed on the contact point support portion 330. As understood from FIGS. 2 and 6, the lower contact point 340 is directed upward.

As illustrated in FIGS. 2 and 4, the second held portion 310 is held by the holding portion 442 of the housing 400 so that the second terminal 300 is held by the housing 400. In this state, the contact point support portion 330 abuts on the stop portion 444 of the housing 400. In the present embodiment, the position of the contact point support portion 330 in the front-rear direction (the X-direction) overlaps a position of the reinforcing portion 240 in the front-rear direction. As understood from FIG. 2, the lower contact point 340 protrudes into the object receiving portion 410.

As illustrated in FIG. 1, the second terminals 300 are arranged in the pitch direction (the Y-direction) and held by the housing 400. As understood from FIGS. 2 and 4, the first terminal 100 and the second terminal 300 corresponding thereto are situated at a position same as each other in the pitch direction. As a result, the lower contact point 340 of the second terminal 300 faces the upper contact point 220 of the first terminal 100 in the up-down direction (the Z direction).

Figure 8:
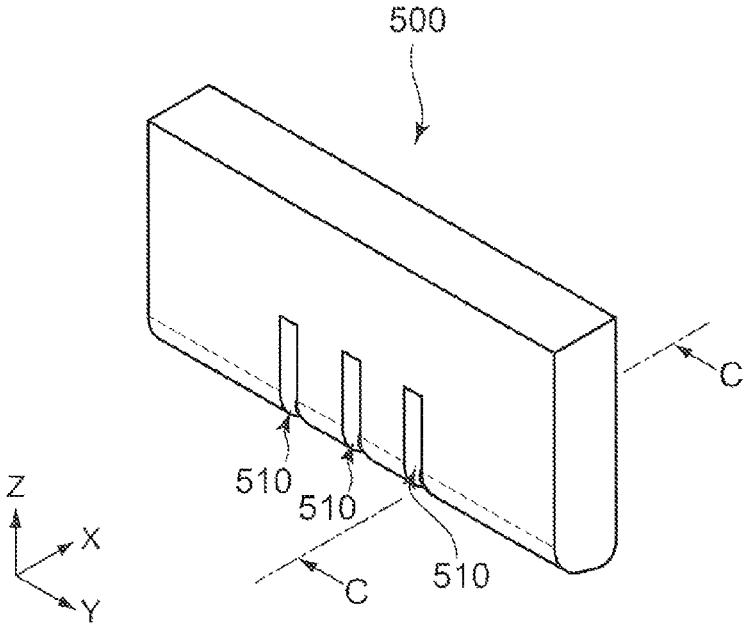
FIG. 8 is a perspective view illustrating the actuator included in the connector of FIG. 1.
Figure 9:
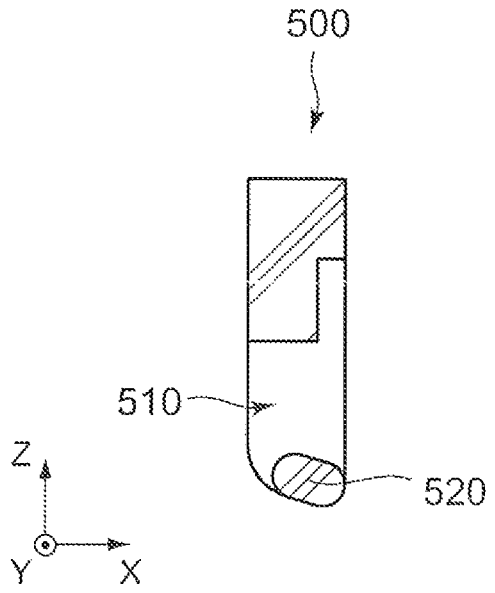
FIG. 9 is a cross-sectional view illustrating the actuator of FIG. 8, taken along line C-C.

As illustrated in FIG. 8, the actuator 500 is formed with three channel portions 510. The channel portions 510 correspond to the first terminals 100 (see FIG. 2), respectively. As illustrated in FIG. 9, in each or the channel portions 510, an actuation cum 520 is provided. As illustrated in FIGS. 2 and 4, the actuator 500 is attached to the first terminal 100 so that the actuator 500 is accommodated in the actuator accommodation portion 420 in part and that the actuation cum 520 is situated between actuated portions 260. This attaching allows the actuator 500 to be rotated between an open state shown in FIG. 2 and a close state shown in FIG. 4.

As understood from FIG. 2, when the actuator 500 is in the open state, the actuation cum 520 does not apply a load to the actuated portions 260. In this situation, a dimension of a distance between the upper contact point 220 and the lower contact point 340 in the up-down direction is larger than another dimension of a thickness of the connection object 600 (see FIG. 4). Consequently, when the actuator 500 is in the open state, the connection object 600 can be inserted in the object receiving portion 410 without insertion force.

On the other hand, as understood from FIG. 4, when the actuator 500 is in the close state, the actuation cum 520 widens an interval between the actuated portions 260 so that the upper contact point 220 is moved downward. In this situation, the connection object 600 is interposed between the upper contact point 220 and the lower contact point 340 in the up-down direction. Particularly, when the connection object 600 is connected to the connector 10, the upper jaw portion 210 presses the upper contact point 220 against the upper signal line 620 of the connection object 600. At this time, the lower signal line 640 presses the lower contact point 340 downward. As a result, the contact point support portion 330 receives a downward force via the lower contact point 340 and is pressed against the stop portion 444. In the present embodiment, the stop portion 444 is a part of the upper wall 450. Accordingly, when the connection object 600 is connected to the connector 10, the upper wall 450 receives a force for deforming the upper wall 450 downward. In this situation, the reinforcing portion 240 reinforces the upper wall 450 from beneath (the negative-Z side). In other words, the reinforcing portion 240 opposes the force for deforming the upper wall 450 downward. In this manner, the reinforcing portion 240 of the lower jaw portion 230 reinforces the upper wall 450 that receives the force, which is caused by a force applied from the upper jaw portion 210, for deforming the upper wall 450 downward. Thus, a load, caused by connection of the connection object 600 and applied to the housing 400 can be reduced. Therefore, strength required for the housing 400 is small. According to the present embodiment, the housing 400 can be downsized and thus the whole of the connector 10 can be downsized.

Especially, in the present embodiment, the contact point support portion 330 is not required to have spring property. Accordingly, the second terminal 300 can be shortened in the front-rear direction (the X-direction). Thus, not only downsizing but also improvement of high-frequency characteristics are achieved.

Second Embodiment

Figure 12:
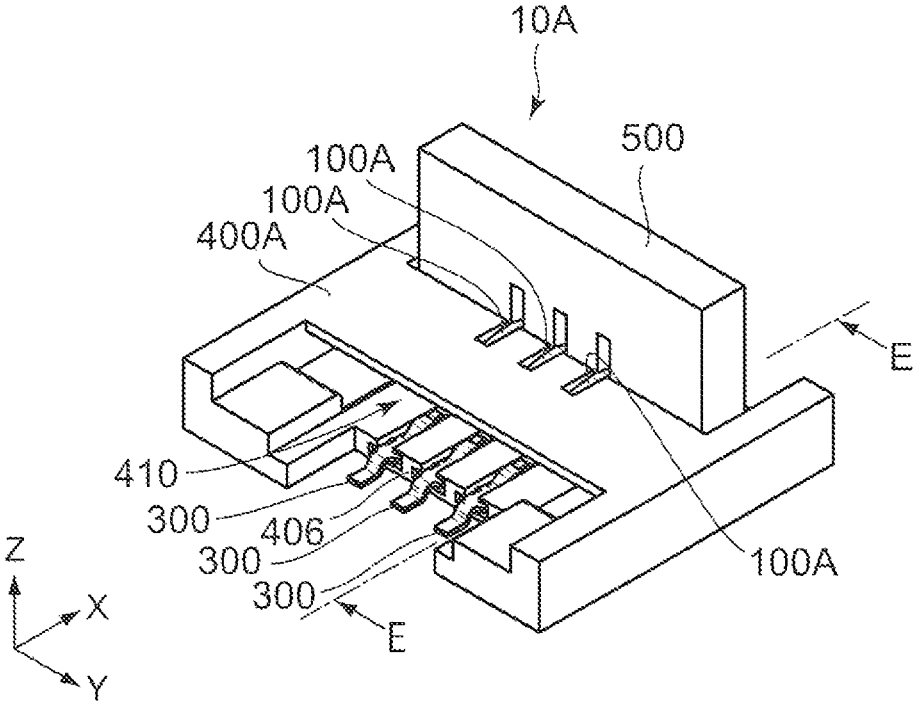
FIG. 12 is a perspective view illustrating a connector according to a second embodiment of the present invention. An actuator included in the connector illustrated is in an open state.
Figure 13:
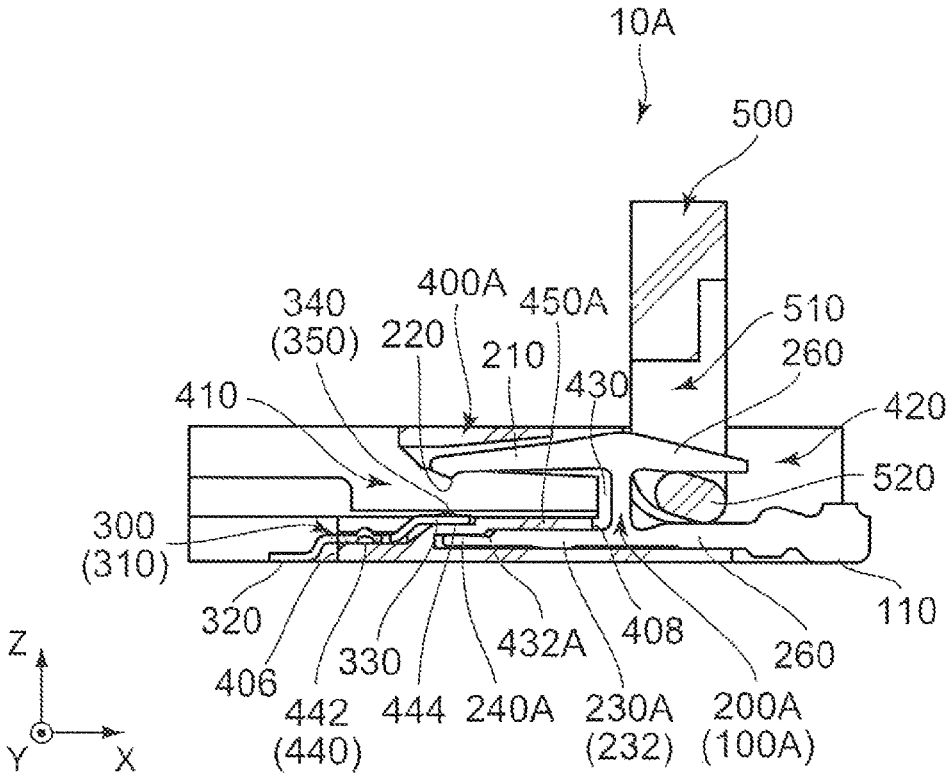
FIG. 13 is a cross-sectional view illustrating the connector of FIG. 12, taken along line E-E.

Referring to FIGS. 12 and 13, a connector 10A according to a second embodiment of the present invention has a structure generally same as the structure of the connector 10 (see FIG. 1) according to the aforementioned first embodiment. Accordingly, components similar to those of the first embodiment among components illustrated in FIGS. 12 and 13 will be designated by the same reference numerals as those of the first embodiment.

As understood from FIGS. 12 and 13, the connector 10A of the present embodiment is provided with first terminals 100A, second terminals 300, a housing 400A and an actuator 500. The second terminals 300 and the actuator 500 are same as those of the connector 10 of the aforementioned first embodiment. In addition, the first terminals 100A and the housing 400A are same as those of the first embodiment in basic structure. Accordingly, points of difference between the present embodiment and the first embodiment will be mainly described hereinafter.

As understood from FIGS. 2 and 13, a lower jaw portion 230A of the first terminal 100A is longer than the lower jaw portion 230 of the first embodiment in the front-rear direction (the X direction). Besides, a lower jaw receiving portion 432A of the housing 400A is longer than the lower jaw receiving portion 432 of the first embodiment in the front-rear direction.

As illustrated in FIG. 13, a tip of the lower jaw portion 230A protrudes forward (toward the negative-X direction) further than the upper contact point 220 in the front-rear direction (the X-direction). In other words, in the front-rear direction, a position of the upper contact point 220 is in a range of a reinforcing portion 240A. Here, if an imaginary straight line parallel to the up-down direction (the Z-direction) is assumed, the upper contact point 220, the lower contact point 340, the stop portion 444 and the reinforcing portion 240A can be situated on the imaginary straight line. That is, when seeing the first terminal 100A separately (before the first terminal 100A is put in the connector 10A), the upper contact point 220 faces the reinforcing portion 240A in the up-down direction (the Z-direction). Accordingly, when the connection object 600 is connected to the connector 10A, a direction of force applied from the upper contact point 220 to the connection object 600 is a direction headed for the reinforcing portion 240A in a straight line. With this structure, the force acts between the upper jaw portion 210 of the first terminal 100A and the lower jaw portion 230A of the first terminal 100A. Accordingly, the reinforcing portion 240A can reinforce the upper wall 450A efficiently in comparison with the first embodiment. In the present embodiment, the housing 400A never be applied with unnecessary load accompanying connection of the connection object 600. Therefore, according to the present embodiment, the housing 400A can be further downsized and thus the whole of the connector 10A can be downsized.

Third Embodiment

Figure 14:
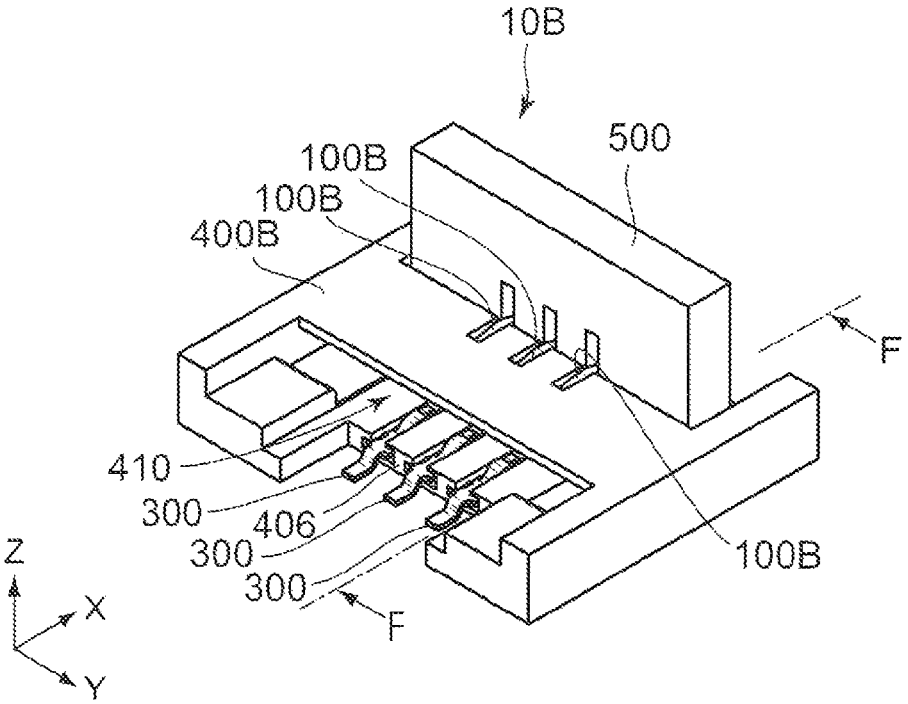
FIG. 14 is a perspective view illustrating a connector according to a third embodiment of the present invention. An actuator included in the connector illustrated is in an open state.
Figure 15:
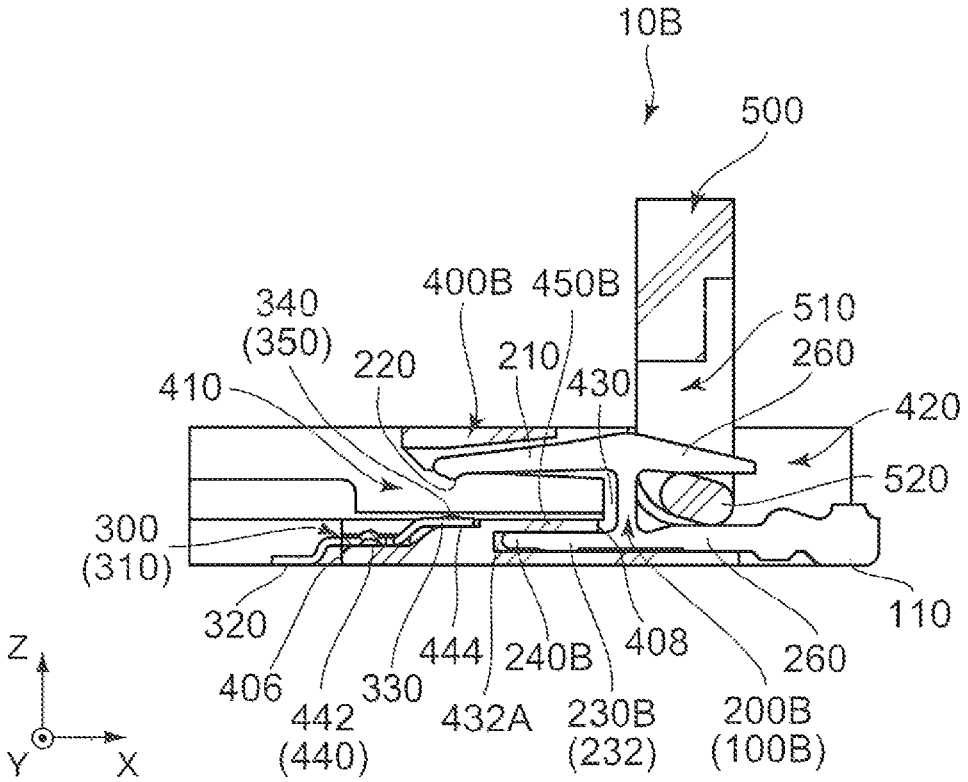
FIG. 15 is a cross-sectional view illustrating the connector of FIG. 14, taken along line F-F.
Figure 16:
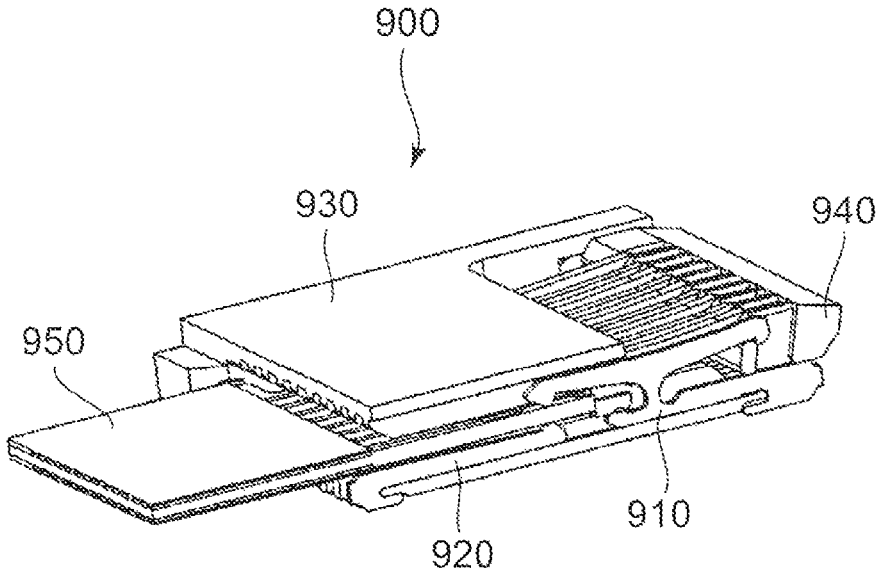
FIG. 16 PRIOR ART
FIG. 16 is a perspective cross-sectional view illustrating a connector of Patent Document 1.

Referring to FIGS. 14 and 15, a connector 10B according to a third embodiment of the present invention has a structure generally same as the structure of the connector 10 (see FIG. 1) according to the aforementioned first embodiment. Accordingly, components similar to those of the first embodiment among components illustrated in FIGS. 14 and 15 will be designated by the same reference numerals as those of the first embodiment.

As understood from FIGS. 14 and 15, the connector 10B of the present embodiment is provided with first terminals 100B, second terminals 300, a housing 400B and an actuator 500. The second terminals 300 and the actuator 500 have structures same as those of the connector 10 of the aforementioned first embodiment. In addition, the first terminals 100B and the housing 400B are basically same as those of the first embodiment in structure. Accordingly, points different from the first embodiment will be described below.

As understood from FIGS. 2 and 15, a lower jaw portion 230B of the first terminal 100B is shorter than the lower jaw portion 230 of the first embodiment in the front-rear direction (the X-direction). An upper surface of the press-fit portion 232 and an upper surface of a reinforcing portion 240B form one plane. Besides, a lower jaw receiving portion 432B of the housing 400B is shorter than the lower jaw receiving portion 432 of the first embodiment in the front-rear direction. That is, the lower jaw receiving portion 432 does not reach the place below the stop portion 444. Accordingly, the stop portion 444 abutting on the contact point support portion 330 of the second terminal 300 is not a part of an upper wall 450B of the over jaw receiving portion 432B. However, the stop portion 444 continues to the upper wall 450B, in other words, the housing 400 has a structure which transmits external force applied to the stop portion 444 to the upper wall 450B.

As understood from FIGS. 4 and 15, also in the present embodiment, when the connection object 600 is connected to the connector 10B, the upper jaw portion 210 presses the upper contact point 220 against the upper signal line 620 of the connection object 600. As a result, the lower signal line 640 presses the lower contact point 340 downward while the contact point support portion 330 is pressed against the stop portion 444. A part of the force applied to the stop portion 444 acts as force to deform the upper wall 450B downward. In this situation, the reinforcing portion 240B reinforces the upper wall 450B from beneath (the negative-Z side) thereof. Here, it is desirable that a position of the reinforcing portion 240B is near the stop portion 444 in the front-rear direction (the X-direction). Specifically, a distance from the upper wall rear end 408 to the reinforcing portion 240B may be longer than a distance from the reinforcing portion 240B to the stop portion 444. Thus, also in the present embodiment, the load applied to the housing 400B can be reduced when the connection object 600 is connected. According to the present embodiment, the housing 400B can be downsized, and thus the whole of the connector 10B can be downsized. In addition, according to the present embodiment, the position of the reinforcing portion 240B in the up-down direction (the Z-direction) can be set without being limited by a position of the stop portion 444. For example, the position of the reinforcing portion 240B can be set at a position upper than the stop portion 444 in the up-down direction.

Although the specific explanation about the present invention is made above referring to the embodiments, the present invention is not limited thereto and is susceptible to various modifications and alternative forms.

For example, although the connectors 10, 10A and 10B are provided with the actuator 500 each, the present invention is not limited thereto. The connector of the present invention may be a connector which has no actuator 500 and needs insertion force for inserting the connection object 600 into the connector.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector connectable with a connection object having a plate-like or sheet-like shape and mountable on a mounting object, wherein the connection object has an upper surface and a lower surface in an up-down direction;

the upper surface and the lower surface are formed with an upper signal line and a lower signal line, respectively;

the connector comprises at least one first terminal, at least one second terminal and a housing;

the housing is formed with a stop portion and a receiving portion extending in a front-rear direction perpendicular to the up-down direction;

the housing has an upper wall defining an upper surface of the receiving portion;

the stop portion continues to the upper wall or is formed of a part of the upper wall;

the at least one first terminal is held by the housing;

each of the at least one first terminal has an upper jaw portion, a lower jaw portion and a first fixed portion;

the upper jaw portion is provided with an upper contact point which is movable at least in the up-down direction;

the lower jaw portion is situated at a position lower than the upper jaw portion in the up-down direction;

the lower jaw portion is received by the receiving portion;

the lower jaw portion is provided with a reinforcing portion;

the first fixed portion is fixed to the mounting object when the connector is mounted on the mounting object;

the at least one second terminal is distinct and separated from the at least one first terminal and held by the housing;

each of the at least one second terminal has two end portions;

one of the end portions is formed with a second fixed portion which is fixed to the mounting object when the connector is mounted on the mounting object;

a remaining one of the end portions is provided with a contact point support portion;

the contact point support portion is formed with a lower contact point thereon;

when the connection object is connected to the connector, the upper jaw portion presses the upper contact point against the upper signal line, and hence the lower signal line presses the contact point support portion against the stop portion via the lower contact point, and the upper wall receives force for deforming the upper wall downward; and the reinforcing portion reinforces the upper wall from beneath;

wherein:

the receiving portion reaches a place below the stop portion;

the stop portion is formed of a part of the upper wall; and a position of the contact point support portion in the front-rear direction overlaps with a position of the reinforcing portion in the front-rear direction.

2. The connector as recited in claim 1, wherein the contact point support portion has a plate-like shape intersecting with the up-down direction.

3. The connector as recited in claim 1, wherein when the connection object is connected to the connector, the connection object is interposed between the upper contact point and the lower contact point in the up-down direction.

4. The connector as recited in claim 3, wherein when an imaginary straight line parallel to the up-down direction is assumed, the upper contact point, the lower contact point, the stop portion and the reinforcing portion are situated on the imaginary straight line.

5. The connector as recited in claim 1, wherein the at least one first terminal is two or more of the first terminals which are distinct and separated from each other;

the at least one second terminal is two or more of the second terminals which are distinct and separated from each other;

the first terminals correspond to the second terminals, respectively;

the housing holds the first terminals and the second terminals so that the first terminals are arranged in a pitch direction perpendicular to both of the up-down direction and the front-rear direction while the second terminals are arranged in the pitch direction: and any one of the first terminals and the second terminal corresponding to the one of the first terminals are situated in a position same as each other in the pitch direction.

6. The connector as recited in claim 1, wherein each of the at least one second terminal has a press-fit portion which is press-fit into the housing: and the press-fit portion is provided between the second fixed portion and the contact point support portion.

7. The connector as recited in claim 1, wherein the reinforcing portion abuts on the upper surface of the receiving portion.

8. The connector as recited in claim 1, wherein the upper wall has a rear end in the front-rear direction;

the lower jaw portion is received by the receiving portion to be directed forward in the front-rear direction; and a distance from the rear end to the reinforcing portion is longer than a distance from the reinforcing portion to the stop portion.

* * * * *